US005857805A

United States Patent [19]

Chappell

[11] Patent Number: 5,857,805

[45] Date of Patent: Jan. 12, 1999

[54] FLOW MODIFICATION APPARATUS, SYSTEM, AND METHOD

[76] Inventor: Derrald H. Chappell, 495 Chalk Creek Rd., Coalville, Utah 84017

[21] Appl. No.: 911,512

[22] Filed: Aug. 14, 1997

Related U.S. Application Data

[63] Continuation-in-part of Ser. No. 238,451, May 5, 1994, Pat. No. 5,678,955.

[51] Int. Cl.[6] ..... E02B 3/00

[52] U.S. Cl. ..... 405/52; 405/15; 405/21; 405/34; 405/80

[58] Field of Search ..... 405/15, 16, 21, 405/29, 30–35, 52, 80; 49/386; 256/12.5, 21, 24

[56] References Cited

U.S. PATENT DOCUMENTS

| | | | |
|---|---|---|---|
| 247,493 | 9/1881 | Gates . | |
| 253,520 | 2/1882 | Du Bois . | |
| 346,140 | 7/1886 | Bates | 405/21 |
| 553,662 | 1/1896 | White . | |
| 566,408 | 8/1896 | Neil . | |
| 656,390 | 8/1900 | Condon . | |
| 1,235,021 | 7/1917 | Follmer . | |
| 1,244,623 | 10/1917 | Mc Clees . | |
| 1,852,268 | 4/1932 | Schmidt | 405/15 |
| 2,000,312 | 5/1935 | Wood | 405/34 |
| 2,097,342 | 10/1937 | Rehfeld | 405/34 |
| 2,106,564 | 1/1938 | Fisk et al. | 405/34 |
| 2,162,499 | 6/1939 | Borhek | 405/15 |
| 2,330,017 | 9/1943 | Taylor . | |
| 2,387,965 | 10/1945 | Wood | 405/34 |
| 2,445,545 | 7/1948 | Verner | 256/35 |
| 2,593,379 | 4/1952 | Wueste | 49/386 |
| 3,423,072 | 1/1969 | Bernstein | 256/24 |
| 3,815,877 | 6/1974 | Turner | 256/24 |
| 4,073,478 | 2/1978 | Bermudez | 256/27 |
| 4,115,954 | 9/1978 | Larkin et al. | 49/386 X |
| 4,174,096 | 11/1979 | Campbell | 256/24 |
| 4,279,535 | 7/1981 | Gaglaidi et al. | 405/15 |
| 4,422,622 | 12/1983 | Broski, Jr. | 256/25 |
| 4,465,262 | 8/1984 | Itri et al. | 256/24 |
| 4,582,300 | 4/1986 | Chappell | 256/36 |
| 4,711,597 | 12/1987 | Ogaard et al. | 405/15 X |
| 5,174,681 | 12/1992 | Atkinson et al. | 405/21 X |

FOREIGN PATENT DOCUMENTS

| | | | |
|---|---|---|---|
| 0055612 | 5/1981 | Japan | 405/15 |

*Primary Examiner*—Dennis L. Taylor
*Attorney, Agent, or Firm*—Madson & Metcalf

[57] ABSTRACT

A method for modifying the flow of water in a channel includes creating a flow modifier by first obtaining a plurality of rigid substantially linear posts and obtaining at least one prefabricated brace configured for connection to the posts. The prefabricated brace is configured with two spaced apart rigid anchor ends, one of which has at least two spaced apart anchor sites. A plurality of rigid cross beams connect the anchor ends, with the cross beams and the anchor ends all substantially coplanar. A plurality of vertically extending vanes may also be arrayed across the prefabricated brace. The method also includes driving at least two of the posts into the channel bed and securely connecting at least one prefabricated brace to the posts at the anchor sites. An agglomeration matrix may be positioned against the prefabricated brace for supporting and accumulating materials which amplify the flow modification effect of the prefabricated brace and matrix. The flow modifier modifies the flow of water by creating a weir, by diverting the flow of water, by reinforcing the channel bank, by creating a favorable habitat for plant life, or by some combination of these effects. An apparatus and system for modifying the flow of water in a channel are also disclosed.

32 Claims, 9 Drawing Sheets

FLOW MODIFICATION APPARATUS, SYSTEM, AND METHOD

RELATED APPLICATIONS

This application is a continuation-in-part of application Ser. No. 08/238,451 filed May 5, 1995 and entitled Flow Modification System and Method now U.S. Pat. No. 5,678,955.

FIELD OF THE INVENTION

The present invention relates to an apparatus, system, and method for modifying the flow of water in a channel. More particularly, the present invention relates to the placement of prefabricated braces in the channel in customized and modular configurations in order to modify the velocity of portions of the flow of water in a predetermined manner and to thereby reduce erosion in selected locations in the channel banks or bed.

TECHNICAL BACKGROUND OF THE INVENTION

Erosion of rivers, streams, canals, ditches, and other water run-off and irrigation carrying channels is a large and expensive problem in the United States and around the world. Many attempts have been made over hundreds of years at reducing the occurrence of erosion in these channels, but after all these years, these attempts still prove unsatisfactory.

Erosion continues to allow channels to shift, to cross property lines, to undercut roads, railways, and buildings, and even to threaten telephone and electric power transmission lines. Erosion creates large gullies which are difficult to cross, inhibiting travel even when the gullies do not carry water. Erosion also alters the paths of rivers and provides the rivers with new access to flood plains which were previously inaccessible and hence were protected against flooding. Erosion also consumes thousands of acres of prime farm land every year.

As used herein, the term "flow of water" denotes a flow of water in a stream, canal, ditch, creek, lake inlet, pond outlet, or other body of moving water. The term "Channel" collectively denotes the bed over which the flow of water moves and the banks between which the flow of water moves. A channel exists regardless of whether or not it carries a flow of water at any particular time. Although many flows are substantially continuous, as in a large river, other flows such as flash floods are intermittent.

Erosion is caused by the force of the flow of water acting against the channel in which the water flows. The amount of force exerted by the flow of water on the banks and bed of the channel is largely dependent on the velocity of the flow of water. Turmoil in the flow of water can also create eddies which eat away at a particular area of the channel. Over time, due to the force of the flow of water, the soil and other materials of the banks and/or bed of the channel are carried away and redeposited downstream, altering the shape of the channel. In many cases, the altered channel guides the flow of water along a substantially different path than the path that was taken before the erosion occurred.

The speed of erosion is also dependent on many other factors. For instance, rocky channels tend to erode more slowly than channels lined only with soil. The presence of trees and other vegetation along the banks of a channel also tends to slow erosion. On the other hand, erosion occurs quickly in arid or semi-arid regions which have sparse vegetation. These same areas are often subject to flash floods which can severely erode the relatively unprotected channels.

Certain portions of the channels also incur greater erosion than other portions of the channels. For instance, much like any moving body, the flow of water tends to exert greater force on the outside of a curve. This force is embodied as a greater velocity of the flow of water, which in turn deepens the channel bed at the outside of the curve. The deeper channel allows an even greater portion of the flow of water to migrate to the outside of the curve, thereby creating even greater erosion on the outside bank and the outer portion of the channel bed.

Prior art attempts at reducing erosion include the placement of a weir in the channel. A weir resembles a dam in that both obstruct the flow of water. Typically, dam blocks substantially all of the water that reaches it, causing the river to overflow its banks directly upstream of the dam and creating a pond or lake. A weir, on the other hand, slows the flow of water without causing substantial overflow of the banks. The portion of the flow of water around the weir is slowed and flows over the top of or around the weir. Thus, the portion of the flow of water around and immediately downstream of the weir is reduced in velocity, thereby decreasing the force of the flow of water acting upon the channel banks and bed. Thus, erosion is diminished immediately adjacent to and downstream of the weir.

The placement of flow diverters in the channel has also been used in attempts to reduce erosion. Flow diverters typically modify the flow of water by redirecting the flow of water thereof away from locations that are particularly vulnerable to erosion.

Attempts to eliminate erosion have also included the reinforcement of vulnerable portions of the channel bank. Various forms of dikes, levees, walls, old car chassis, and other forms of obstructions have been used for this purpose. As used herein, weirs, flow diverters, and reinforcement barricades will be collectively referred to as flow modifiers.

Prior art flow modifiers have been found generally to be expensive, difficult to install, and not aesthetically pleasing. For instance, the construction of rock jetties and walls is time consuming. The construction of wood barricades can also be expensive, and the barricades are short-lived, as wood tends to rot. The rocks, wood, and other materials are also not readily available in many sites. Additionally, the placement of car chassis in rivers and streams is in some cases unlawful.

Furthermore, most flow modifiers are required to be anchored to the stream bed to prevent the flow modifiers from themselves being washed away. Such anchoring can also be difficult and is often ineffective. For instance, when building wood barricades, large diameter wooden posts must be sunk into the channel bed. This normally requires digging a large hole in the channel bed. Digging in the channel bed proves difficult to do, particularly in a rapidly moving flow of water, and can also make the channel bed more susceptible to erosion. The wooden barricades are also undesirable, as the wooden posts are frequently snapped by sudden rushes of water, causing the barricade to be washed away.

From the above discussion, it can be seen that a need exists for an apparatus, system, and method for modifying the flow of water in a channel that is inexpensive, that is easy to install, and that is sturdy and will not wash out. Such an apparatus, system, and method is also needed which is capable of being installed in the stream in a variety of custom configurations in order to modify the flow of water in the channel and thereby reduce erosion in predetermined portions of the channel.

BRIEF SUMMARY OF THE INVENTION

The present invention provides an apparatus, system, and method for modifying the flow of water in a channel. The modified flow of water reduces the force of the flow of water on sensitive locations in the channel banks and bed, thereby reducing or eliminating erosion of the sensitive locations.

Under the present invention, a prefabricated brace is provided for use in providing resistance to selected portions of the flow of water. As contemplated herein, the prefabricated brace comprises two spaced apart rigid anchor ends. In one embodiment, each anchor end comprises an elongated tubing member. Each of the anchor ends preferably is provided with at least one anchor site for connecting the anchor end to a post. One or more rigid cross beams connects the anchor ends, and the cross beams and the anchor ends are preferably substantially coplanar.

In one embodiment of the prefabricated brace, a plurality of vanes are secured to the one or more cross beams between the anchor ends. The plurality of vanes are preferably situated vertically in an array across the prefabricated brace. Each of the plurality of vanes is preferably of a width of about one to about five inches across and a height coextensive with the height of the prefabricated brace. The vanes are preferably thin in cross-sectional depth, in order to reduce weight and cost. Typically the vanes are less than an inch in depth, and more preferably the vanes are less than about a quarter inch in depth.

Typically between about five and about twenty vanes will be secured to the prefabricated brace. The width of the vanes and the space between the vanes is selected according to the amount of flow reduction desired. Typically, the vanes occupy about half of the surface area of the prefabricated brace, and more preferably occupy more than half of the surface area of the prefabricated brace.

In another embodiment of the prefabricated brace, the anchor ends form the legs of an inverted substantially U-shaped member of the prefabricated brace. The top of the inverted U forms one of the cross beams, and additional cross beams form an X between the legs of the U. In another embodiment, the top of an inverted U forms one cross beam and another cross beam forms an inverted V between the legs of the U. In a third embodiment of the prefabricated brace, one of the anchor ends comprises one leg of an L-shaped member, one of the cross beams comprises the other leg of the L-shaped member, and a second cross beam spans the separated end points of the L-shaped member's legs to form a triangle. The cross beams and anchor ends in each of these embodiments are preferably formed out of tubing or beams constructed from steel, composite, or plastic tubing, and hence pose minimal risk of releasing environmental contaminants into the water. The tubing or beams can be of any cross-sectional shape, and can be hollow or solid.

Under one embodiment of the method of modifying the flow of water in a channel, a plurality of substantially linear posts such as conventional steel T-posts used in fencing applications are provided. One or more prefabricated braces are then placed in the channel in a manner that alters the resistance offered to the flow of water by the channel. The prefabricated braces are preferably secured in place by securing one anchor end to a first steel post and a securing a second anchor end to a second steel post. Of course, other manners of anchoring the prefabricated braces in the channel could also be used.

The prefabricated braces are secured in an appropriate configuration to modify the flow of water in a manner that will reduce the force of the water on one or more banks of the channel or on the channel bed. The configuration of the prefabricated brace to be employed is selected in accordance with the particular erosion problem. The total number of prefabricated braces and posts used in the configuration depends on the size of the channel, the flow modification desired, and other considerations.

As one example of a suitable configuration of the flow modification system of the present invention, prefabricated braces are placed in a path that stretches from one bank of the channel to the opposite bank to prevent erosion along both banks and the entire channel bed. The path may be an arcuate path having a convex side facing upstream to better resist the force of the flow of water.

Alternative configurations can also be used in which the prefabricated braces are situated along other paths, including a straight path, a path that extends from one bank toward the other bank without reaching it, a mid-channel path that reaches neither bank, and a path that hugs one bank without extending toward the other bank.

A plurality of prefabricated braces can be configured in an enclosure, in which the prefabricated braces surround three or more sides of a region of the channel. Prefabricated braces can be deployed in a line perpendicular to the flow of water, and if necessary, additional prefabricated braces can be connected to the steel posts between the perpendicular prefabricated braces extending back downstream to brace the perpendicular prefabricated braces.

Also, in order to prevent gouging of the bottom of the channel, prefabricated braces can be placed in the channel with one prefabricated brace positioned vertically between two steel posts in the manner described, and a second prefabricated brace connected to the first prefabricated brace and/or to the steel posts and laying horizontally on the bottom of the channel.

One further alternative configuration secures a first prefabricated brace or a plurality of prefabricated braces along an upstream path and a second prefabricated brace or a plurality of prefabricated braces along a downstream path to form a terraced weir. Multiple downstream paths can be used.

Additionally, in any of the above-described configurations, the prefabricated braces can be of differing heights. Thus, when two braces are placed side by side in a perpendicular facing in the channel, and one is higher than the other, more of the flow of water will be diverted from the portion of the channel downstream of the higher brace than from the portion of the channel immediately downstream of the shorter brace.

In an alternative configuration, a plurality of prefabricated braces are placed partially or fully enclosing a predetermined region of the channel. Erosion is reduced in the region, and the channel bed within the region can actually be reclaimed by the buildup of silt deposited in the region due to the reduced velocity of the flow of water therein. Moreover, the prefabricated braces around the region can create a favorable habitat by allowing the growth of plant life and preventing existing plant life in the region from being uprooted.

In a further optional embodiment of the method of modifying the flow of water in a channel, an agglomeration matrix is positioned against the prefabricated brace on the upstream side of the prefabricated brace. The agglomeration matrix modifies the water flow by supporting and accumulating over time an agglomeration of materials which are carried against the matrix by the water in the channel. These materials amplify the flow modification effect of the prefabricated brace and matrix. A suitable matrix may be formed from wire net, plastic mesh, or other material, but is preferably perforated or otherwise made fluid permeable. The matrix and prefabricated braces may also be used to hold rocks or other natural materials in place as part of a flow modifier. For instance, the rocks may be placed upstream of the prefabricated brace against a flap portion of the matrix which extends outwardly from the prefabricated brace along the channel bed.

The system of the present invention comprises one or more prefabricated braces of the present invention together with a plurality of steel posts to which the prefabricated braces are fastened in order to modify the flow of water in a channel.

These and other features and advantages of the present invention will become more fully apparent through the following description and appended claims taken in conjunction with the accompanying drawings.

BRIEF DESCRIPTION OF THE DRAWINGS

In order to understand the manner in which the above-recited and other advantages and features of the invention are obtained, a more particular description of the invention summarized above will be rendered by reference to the appended drawings. Understanding that these drawings only provide selected embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 1:
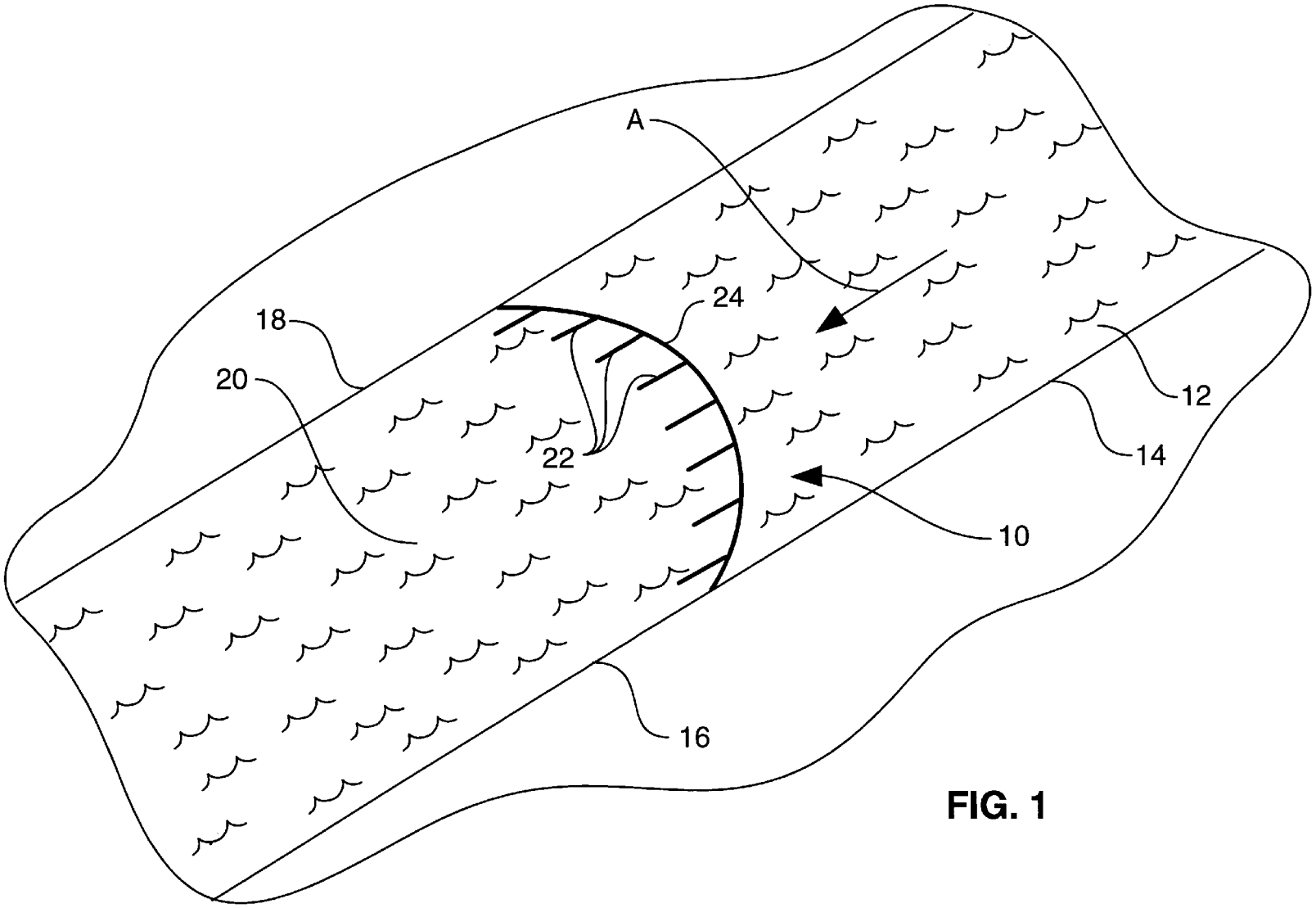
FIG. 1 is a perspective view of a channel in which a system of prefabricated braces has been assembled according to the present invention for modifying the flow of water in the channel.

Reference is now made to the figures wherein like parts are referred to by like numerals. Shown in FIG. 1 is one embodiment of a system for modifying the flow of water in a channel. As seen therein, a flow modification system 10 has been placed within a channel 14 so as to modify a flow of water 12 in the channel 14. The flow of water 12 moves generally from upstream to downstream as indicated by Arrow A, within the channel 14 which extends between a first bank 16 and a second bank 18 and over a channel bed 20.

Under the present invention, the resistance encountered by the flow of water 12 is modified by placing one or more structures in the channel 14. Thus, in accordance with the method of the present invention, at least one prefabricated brace 22 configured for placement in the channel 14 is initially obtained. The method further comprises placing the prefabricated brace 22 in the channel 14 such that the prefabricated brace 22 modifies the resistance offered to the flow of water 12, and securing the prefabricated brace 22 in position with respect to the channel bed 18.

The prefabricated braces 22 are modular and may be placed and secured in the channel in a variety of configurations in accordance with the present invention. FIG. 1 illustrates an embodiment in which a plurality of prefabricated braces 22 have been placed in the channel and are secured in position along a path 24. The path 24 stretches from one bank 16 to the opposite bank 18 of the channel 14. The path 24 is arcuate, having a convex side facing upstream to better resist the force of the flow of water 12.

In accordance with the present invention, one or more prefabricated braces 22 can also be placed in other configurations and along other paths within the channel 14, including but not limited to a straight path, a path that extends from one bank toward the other bank without reaching it, a mid-channel path that reaches neither bank, and a path that hugs one bank without extending toward the other bank. Moreover, a plurality of prefabricated braces 22 is not required, as the present method also includes placing and securing a single prefabricated brace 22 within the channel 14 in order to modify the flow of water 12 in the channel 14.

Figure 2:
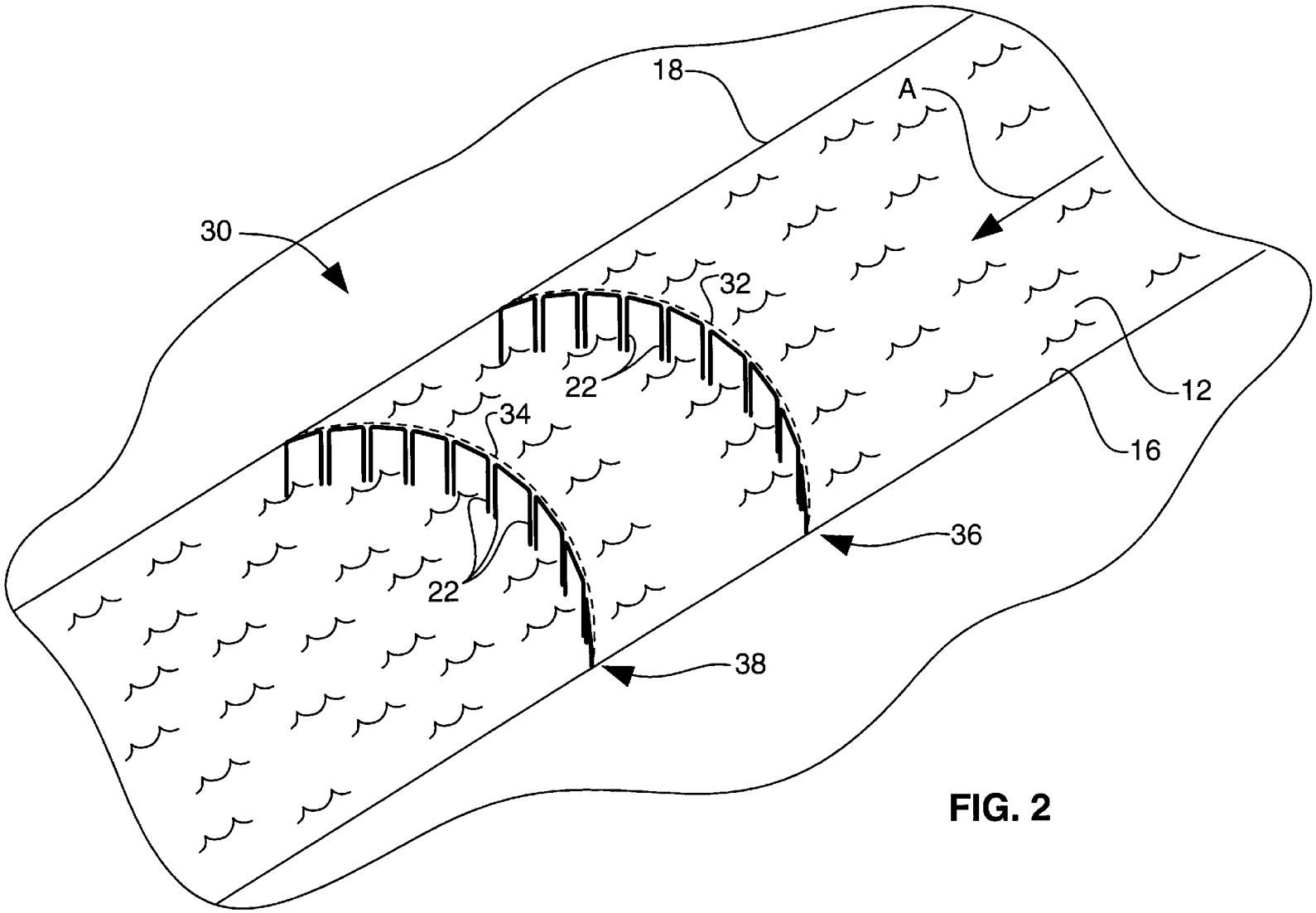
FIG. 2 is a perspective view of a channel in which a terraced weir has been formed according to the present invention.

FIG. 2 illustrates an alternative configuration of the flow modification system 10 in which several prefabricated braces 22 are placed in the channel 14 and are secured along an upstream path 32 and also along a downstream path 34. A terraced weir 30 is formed thereby that includes an upstream terrace 36 formed with the prefabricated braces 22 along the upstream path 32 and a downstream terrace 38 formed with the prefabricated braces 22 along the downstream path 34. Those of skill in the art will appreciate that additional terraces may also be added according to the teachings of the present invention.

Figure 3:
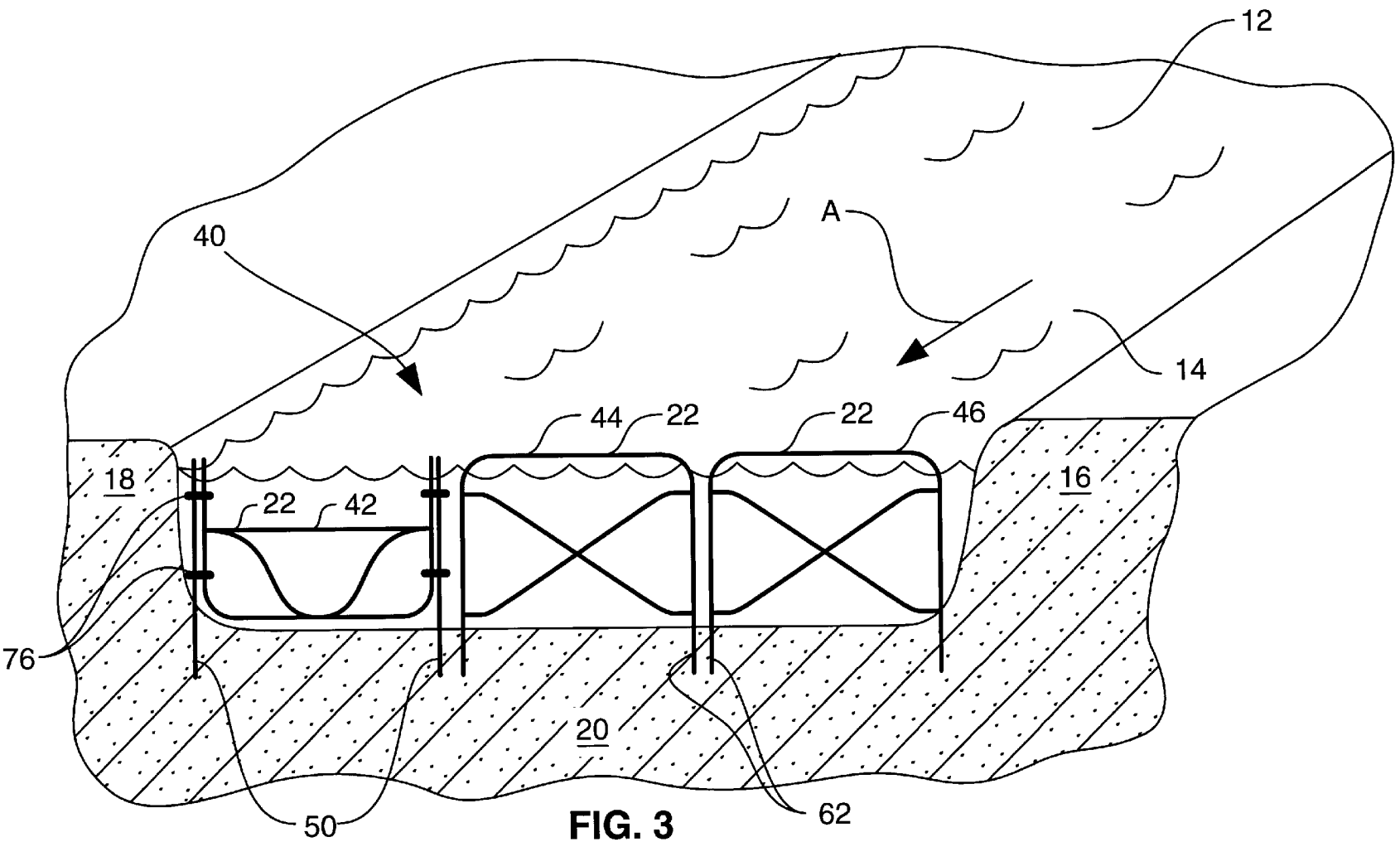
FIG. 3 is a perspective view with a cross section exposed to illustrate the formation of a diversion according to the present invention.

FIG. 3 illustrates an alternative embodiment in which several prefabricated braces 22 are placed in the channel 14 and are secured in a configuration which functions as a flow diverter 40. A low prefabricated brace 42 is placed in the channel 14 and secured in position relative to the channel bed 20. A high prefabricated brace 44 is also placed in the channel 14, and is secured in position adjacent the low prefabricated brace 42. The height of the high prefabricated brace 44 is such that the height above the channel bed 20 of at least a portion of the high prefabricated brace 44 is greater than the height above the channel bed 20 of substantially all of the low prefabricated brace 42. Thus configured, the high prefabricated brace 44 diverts a portion of the flow of water 12 toward the low prefabricated brace 42. Additional prefabricated braces 22, such as an additional high prefabricated brace 46, may be added to further modify the flow of water 12. The portion of the flow of water 12 immediately downstream of the high prefabricated braces 44 and 46 is thereby reduced in velocity, and the channel bank 16 downstream of the high prefabricated braces 44 and 46 is thereby substantially preserved from erosion.

In other alternative configurations, the low prefabricated brace 42 may be upright rather than inverted as shown in FIG. 3. Moreover, the connectors 76 are employed to connect a plurality of posts 50, a plurality of prefabricated braces 22, or a combination of one or more posts 50 with one or more prefabricated braces 22. Thus, the prefabricated braces 44, 46 which are shown in FIG. 3 secured without posts 50 may be connected to one another with connectors 76.

Figure 4:
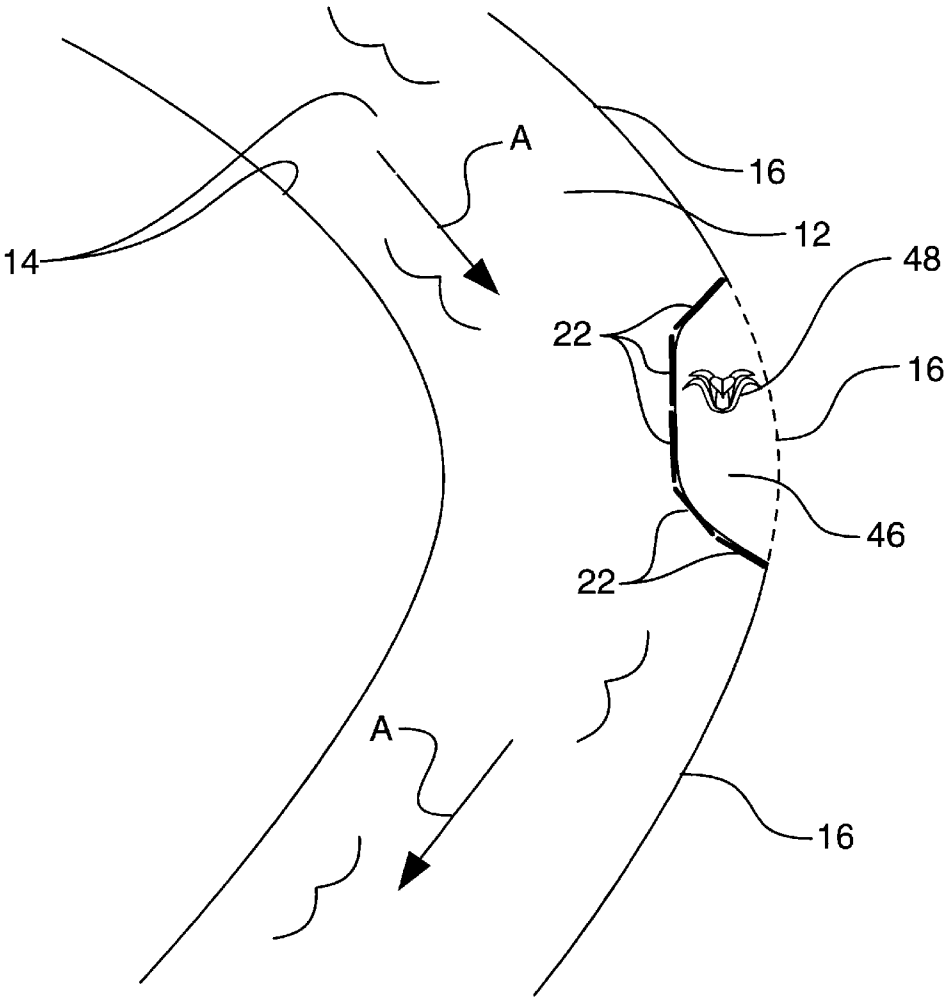
FIG. 4 is a perspective view of a channel in which a region creating a habitat for plant life has been formed according to the present invention.

FIG. 4 illustrates an alternative embodiment in which a plurality of prefabricated braces 22 are placed in the channel 14 and secured such that the prefabricated braces 22 and the channel bank 16 substantially define a region 46 which is desired to be protected from erosion. The prefabricated braces 22 modify the flow of water 12 to reduce erosion of the region 46, thereby creating a favorable habitat for the growth of plant life 48 in the region 46. Repeated erosion of a potential habitat interferes with the establishment of plant life root systems. By reducing the erosion of the region 46, the prefabricated braces 22 provide plants 48 with the time they need to grow adequate root systems.

If the soil originally in the region 46 is inadequate, additional or replacement soil that is more appropriate is placed in the region 46. Trees, bushes, or grasses 48 are then planted or permitted to grow in the region 46. After they are sufficiently established, the root systems of such plant life 48 will reinforce the bank 16 of the channel 14. Once the plant life 48 is well-established, the prefabricated braces 22 may be removed, and the plants 48 will remain behind as a natural flow modifier in the region 46.

Figure 5:
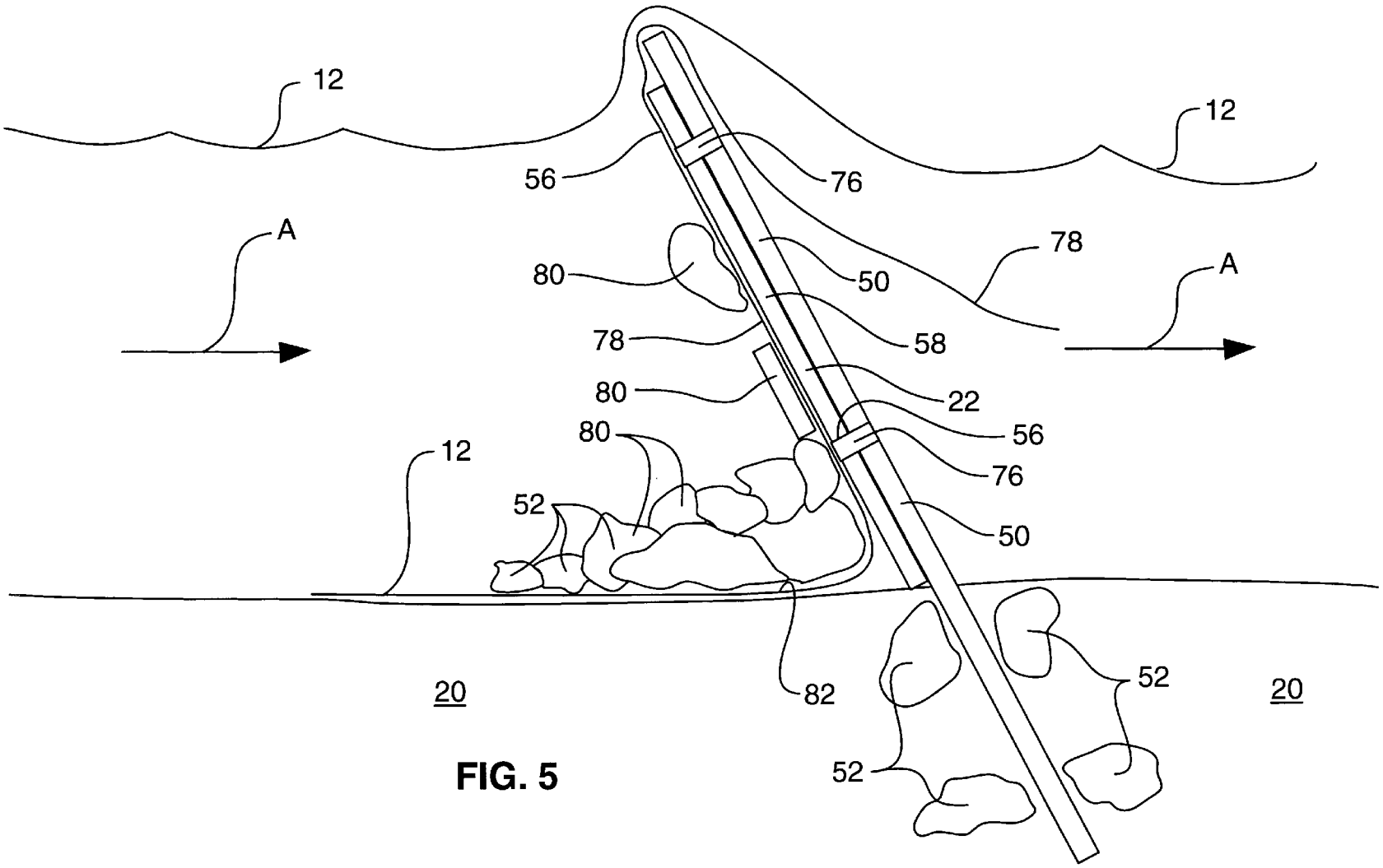
FIG. 5 is a cross sectional view of a post and a prefabricated brace positioned in a channel to modify the flow of water.

With reference to FIG. 5, one embodiment of the method of the present invention includes the step of obtaining a plurality of rigid substantially linear posts 50. The posts 50 may be conventional steel T-posts used in fencing applications, pipes, bars, or other rigid and substantially linear members. The diameter of the posts 50 is preferably small enough to facilitate driving the posts 50 into the channel bed 20 past rocks 52.

In addition to obtaining a plurality of suitable prefabricated braces 22 and posts 50, as illustrated in FIG. 5, one embodiment of the method of the present invention includes the step of driving at least two of the posts 50 into the channel bed 20. Although FIG. 5 illustrates a post 50 driven in at a particular angle with respect to the channel bed 20, different applications of the present invention may call for posts 50 to be driven at other angles. All angles, including right, acute, and obtuse angles are contemplated for placement of the posts 50 and prefabricated braces 22 relative to the channel bed 20 so long as the prefabricated braces 22 are placed to modify the resistance offered to the flow of water 12.

As illustrated in FIG. 5, the embodiment employing posts 50 also includes the step of securely connecting at least one prefabricated brace 22 to two of the posts 50 by connecting at least one anchor site 56 on one anchor end 54 to one of the posts 50 with a connector 76 and connecting at least one anchor site 56 on the other anchor end 58 to a second post 50 with additional connectors 76. The prefabricated brace 22 is shown connected to the posts 50 such that the prefabricated brace 22 is substantially coplanar with the posts 50, but it will be appreciated that the prefabricated brace 22 may be connected to the posts 50 in other ways. It is presently preferred that the connectors 76 be conventional steel clamps, but cable ties, wires, nylon rope, or other convenient and durable connectors may also be employed.

An alternative embodiment of the method of the present invention includes the further step of positioning an agglomeration matrix 78 against the prefabricated brace 22 on the upstream side of the prefabricated brace 22. The agglomeration matrix 78 modifies the water flow 12 by supporting and accumulating over time an agglomeration of materials 80 which are carried against the matrix 78 by the water 12. The materials 80 may include, for instance, tree branches, vegetation, sand, gravel, and rocks 52. The materials 80 amplify the flow modification effect of the prefabricated brace 22 and the matrix 78. In a presently preferred embodiment, the matrix 78 includes a section of plastic mesh or wire net, but other durable material which permits the water 12 to continue flowing past or over the prefabricated brace 22 may also be used. The matrix 78 is preferably fluid permeable by virtue of perforations, orifices, or another means.

The matrix 78 and prefabricated brace 22 may also be used to hold rocks 52 or other natural materials in place as part of a flow modifier. For instance, rocks 52 may be placed upstream of the prefabricated brace 22 against a flap portion 82 of the matrix 78 which extends outwardly from the prefabricated brace 22 along the channel bed 20. Rocks 52 thus placed assist in anchoring the matrix 78 in position relative to the prefabricated brace 22 and the channel bed 20, and also act to slow or otherwise modify the flow of water 12.

Figure 6:
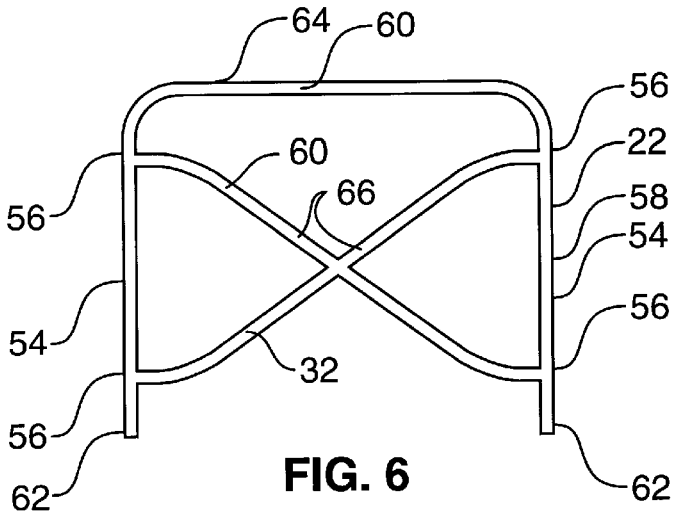
FIG. 6 illustrates an embodiment of the prefabricated brace which includes an inverted U-shaped member and cross beams forming an X.
Figure 7:
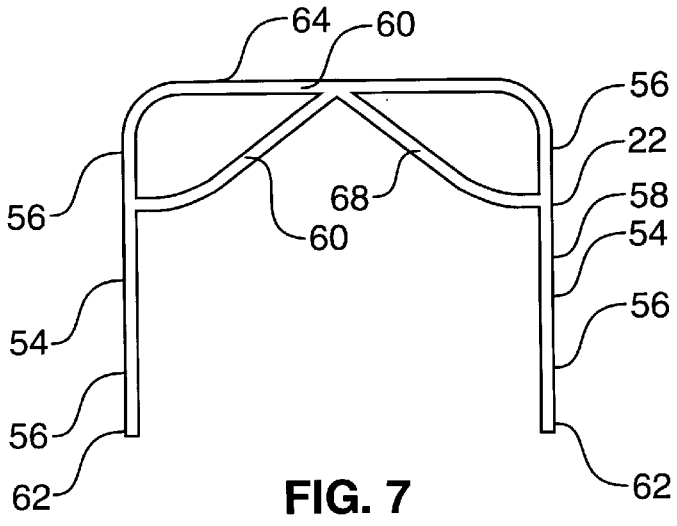
FIG. 7 illustrates an embodiment of the prefabricated brace which includes an inverted U-shaped member and cross beams forming an inverted V.
Figure 8:
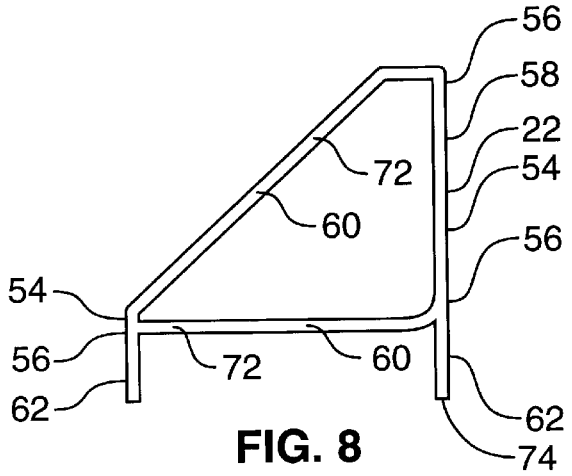
FIG. 8 illustrates an embodiment of the prefabricated brace which includes an L-shaped member and a cross beam forming a triangle.

As illustrated in FIGS. 6 through 8, each prefabricated brace 22 of the present invention is configured with two spaced apart rigid anchor ends 54. Each of the anchor ends 54 has at least one anchor site 56 for connecting the anchor end 54 to one of the posts 50. Each anchor site 56 is preferably not fixed in place, but may rather be chosen at any convenient location along the anchor end 54. A plurality of rigid cross beams 60 connect the anchor ends 54 and 58. The cross beams 60 and the anchor ends 54 are preferably substantially coplanar.

As an alternative to connecting the prefabricated brace 22 to the posts 50 as shown in FIG. 5, the prefabricated brace 22 may be equipped with feet 62 which are disposed and configured to be driven into the channel bed 20 as represented by prefabricated braces 44 and 46 of FIG. 3. So configured, the prefabricated brace 22 may be utilized either with or without posts 50. Conversely, the prefabricated brace 22 may be configured without feet 62, so that the use of posts 50 is not merely possible but is also required in order to secure the prefabricated brace 22 in position with respect to the channel bed 20.

Several embodiments of the prefabricated brace 22 of the present invention are illustrated in FIGS. 6 through 8. As shown in FIG. 6, the anchor ends 54 form the legs of an inverted substantially U-shaped member of the prefabricated brace 22. In the embodiment of FIG. 6, the top 64 of the inverted U forms one of the cross beams 60, and additional cross beams 66 form an X between the legs of the U. In the embodiment illustrated in FIG. 7, the top 64 of the inverted U forms one cross beam, while another cross beam 68 forms an inverted V between the legs of the U.

In the embodiment of FIG. 8, one of the anchor ends 58 comprises one leg of an L-shaped member, and one of the cross beams 70 comprises the second leg of the L-shaped member. A second cross beam 72 spans the separated end points of the L-shaped member's legs to form a triangle. In three other embodiments, the prefabricated brace 22 includes only the left foot 62, only a right foot 74, and neither of the feet 62, respectively. The embodiments illustrated are provided by way of example only, as many other embodiments of the prefabricated brace may be used according to the teachings herein. For instance, the anchor ends 54 need not be linear, so long as adequate anchor sites 56 are provided.

The cross beams 60 and anchor ends 54 of the prefabricated braces 22 should be configured for placement in the flow of water 12. Thus, the cross beams 60 and the anchor ends 54 are preferably constructed of tubing or beams formed from steel, composite, plastic, or another material which has sufficient structural strength to resist the force of the flow of water 12. The tubing or beams can be of any cross-sectional shape, and can be hollow or solid. In addition, the prefabricated braces 22 are preferably formed of such materials which pose little risk of releasing environmental contaminants into the water. In a presently preferred embodiment, the prefabricated braces 22 are formed of one inch square 16 gauge steel tube, and all joints between cross beams 60 and anchor ends 54 are butt welded. The prefabricated braces 22 may be partially or entirely coated with water-resistant paint or a similar conventional protective covering.

Figure 9:
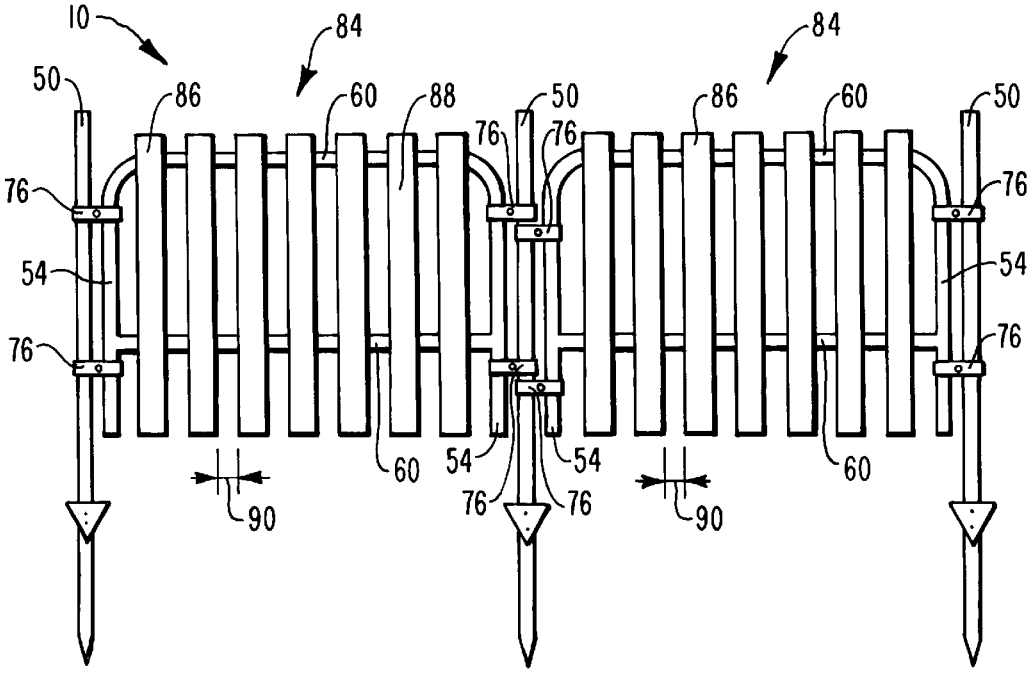
FIG. 9 illustrates a flow modification system of the present invention including a plurality of posts and two prefabricated braces secured between the posts.

FIG. 9 shows an additional embodiment of the prefabricated brace of the present invention. Shown in FIG. 9 is a flow modification system 10 placed within a channel 14 so as to modify a flow of water 12 in the channel. The flow modification system 10 of FIG. 9 includes three posts 50 between which are connected a pair of prefabricated braces 84. The prefabricated braces, 84 of FIG. 9 are substantially similar to the prefabricated braces 22 of FIGS. 1 through 8. Thus, the prefabricated braces 84 each comprise a pair of anchor ends 54 between which are secured a plurality of cross braces 60. Each of the anchor ends 54 is suitable as an anchor site for connecting to a post 50.

Unlike prefabricated braces 22 of FIGS. 1 through 8, however, the prefabricated braces 84 of FIG. 9 are provided with a plurality of vanes 86 thereon connected to the cross braces 60 between the anchor ends 54. The vanes 86 are preferably arranged in arrays on the prefabricated braces 84 and are oriented vertically. A frontal surface 88 (best seen in FIG. 12) of each the vanes 86 is presented to the front of the prefabricated brace 84 with the same facing as the prefabricated brace 84.

The frontal surface 88 of the vanes 86 has a width sufficient to provide a substantial resistance to the flow of water 12. Thus, it is preferred that the frontal surface 88 have a width of between about 1 inch to about 5 inches. The vanes 86 are preferably of a height approximately coextensive with the height of the anchor ends 54, but need not necessarily be so. The vanes 86 are preferably thin in cross-sectional depth, in order to reduce weight and cost. Typically, the vanes 86 are less than an inch in depth, and more preferably the vanes 86 are less than about a quarter inch in depth.

Preferably between about five and about twenty vanes 86 are secured to the prefabricated brace 84. The width of the vanes 86 and the width of the spaces 90 between the vanes 86 is selected according to the amount of flow reduction that is desired.

The amount of resistance presented to the flow of water 12 is selected so that the velocity of the water is significantly slowed around the area in which erosion is to be reduced, and is preferably selected so that the resistance presented is not so great that it causes the flow of water to overflow the banks 16, 18 of the channel 14. It has been found for most applications that the vanes 86 should occupy about half of the surface area of the prefabricated brace 84. In slower moving channels, the vanes should occupy slightly more than half of the surface area of the prefabricated brace 84.

The prefabricated braces 84 so configured do not present an impenetrable barrier to the flow of water as do most prior art weirs. Rather, a permeable, partial barricade is provided which is not dependent upon the accumulation of floating debris to provide the resistance to the flow of water 12. Because some of the flow of water 12 is allowed to pass through the prefabricated braces 84, less force is exerted thereon. Thus, the prefabricated braces 84 of the flow modification system 10 of the present invention have less of a tendency to be washed away by the force of the flow of water 12 than prior art flow modifiers. Nevertheless, the velocity of the flow of water 12 is still slowed significantly. The modularity, sturdiness, and ease of installation of the flow modification system 10 also increase the effectiveness of the flow modification system 10 by allowing the flow of water 12 to be modified in a myriad of customized configurations. Many of these customized configurations are not possible with the prior art flow modifiers because of a lack of sturdiness or are cost prohibitive to form with the prior art flow modifiers.

FIGS. 9 through 13 show additional configurations of the flow modification system 10 of the present invention which use prefabricated braces 84 provided with the vanes 86 of the present invention. Of course, these configurations could also be formed with prefabricated braces 22 which do not have vanes 86 thereon. In the configuration shown in FIG. 9, two prefabricated braces 84 are connected to a common post 50 for placement in the channel 14 (not shown) in a straight path perpendicular to the flow of water 12 to act as a weir. The far anchor ends 54 of each of prefabricated braces 84 are also each connected to a post 50. Posts 50 in the depicted embodiment are steel T-posts.

One advantage of using steel T-posts or similarly configured posts is that the steel T-posts are easily secured in place in the channel 14. In placing the steel T-posts in the channel 14, a post driver, which is typically a cylinder with an integral cap, is driven against the steel posts and rams the steel posts into the channel bed 20. Thus, holes need not be dug into the channel bed 20, and the channel bed 20 is minimally disturbed, so that erosion is not caused by the installation of posts 50. Accordingly, due to the prefabrication of prefabricated braces 84 and the ease of installing and anchoring posts 50 in the channel bed 20, the invention provides the added advantage of being easier to install than the aforementioned prior flow modifiers.

One additional advantage of the present invention is that due to the sturdy nature of the prefabricated braces 84, and the manner in which the prefabricated braces 84 are secured in the channel between steel T-posts, the prefabricated braces 84 can be secured in a facing which is perpendicular to the flow of water 12 in the channel 14. In such a configuration the vanes 86 are also oriented perpendicular to the flow of water 12. With a less sturdy configuration, as with prior art flow barriers, placing the high amount of surface area of the prefabricated braces 84 in such a facing would cause the prefabricated braces 84 to be quickly washed away by the force of the flow of water 12.

As mentioned, one advantage of the present invention is that the flow modification system 10 of the present invention is modular and is thus easily customized in a variety of configurations as needed to preserve the channel 12 from erosion. Thus, the present invention is flexible and can be used for a variety of applications of modifying the flow of water in a channel and thereby reducing erosion. Due to the modular, prefabricated nature of the prefabricated braces 84 of the present invention, the flow modification system 10 of the present invention is also easily removed once its purpose is met. Thereafter, unlike prior art flow modifiers, the flow modification system can be quickly and easily reinstalled in a different location and/or in a different configuration.

Figure 10:
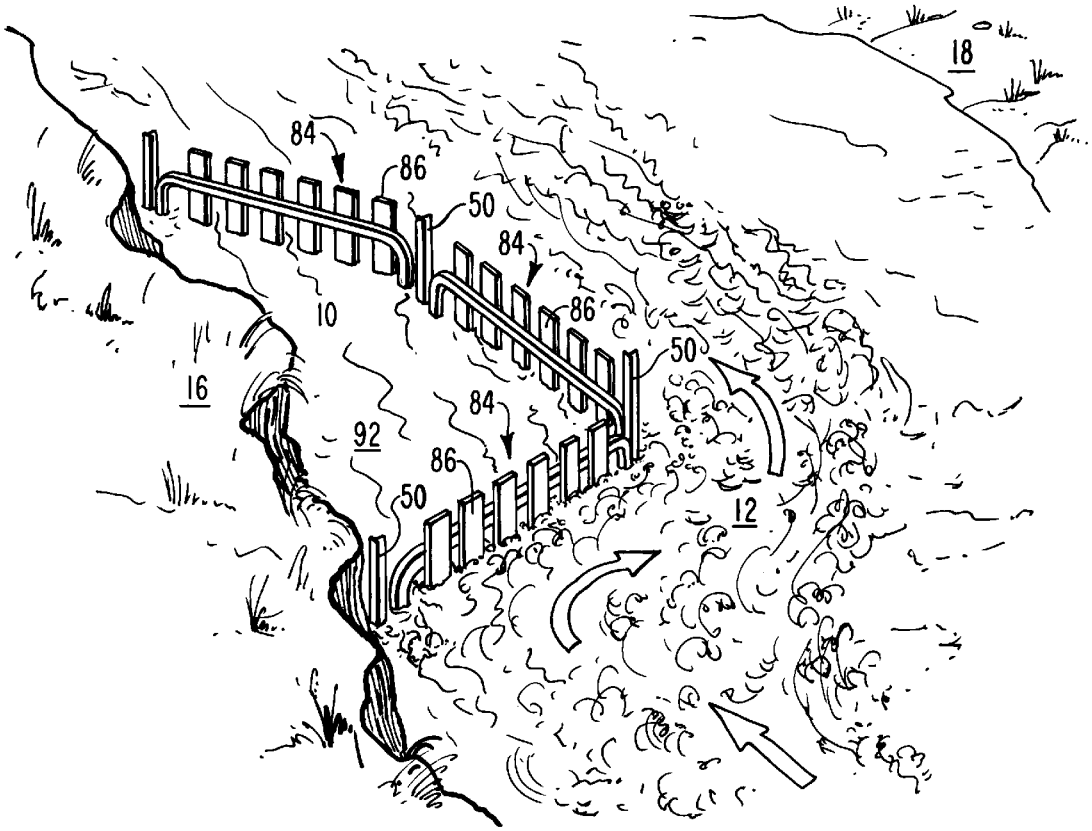
FIG. 10 illustrates a configuration of the prefabricated braces of the present invention in which the prefabricated braces enclose a region of a channel on three sides.

FIG. 10 shows an additional novel configuration of the flow modification system 10 allowed by the unique qualities of the present invention. As seen therein, a plurality of prefabricated braces are installed between posts 50 in the afore-described manner in an enclosed configuration. Thus, the prefabricated braces 84 surround on three sides a region 92 of the channel 14. In this manner, the flow modification system 10 is better anchored to the channel bed 20. Additionally, due to the reduced velocity of the flow of water 12 within the region 92, silt is caused to be deposited in the region 92, and the portion of the channel bed 20 within the region 92 increases in height. In this manner, the region can be reclaimed and made useable to grow crops or for other purposes. Additional fill can also be optionally placed in the region and vegetation can be planted therein. Once the region emerges above the level of the flow of water 12, vegetation will typically begin to grow.

Due to the protection provided by the prefabricated braces 84 as described above, the vegetation within the region will be protected from being uprooted when the flow of water increases in depth and the vegetation will itself help to prevent erosion. The increased vegetation will also serve to slow flash floods.

Of course, the enclosure need not be three sided, and could have two, three, four, or more sides. The region could be partially enclosed as shown, or it could be fully enclosed. The region could be bounded on one side by the channel bank, and on all other sides by prefabricated braces 22 of the present invention, as shown in FIG. 4.

Figure 11:
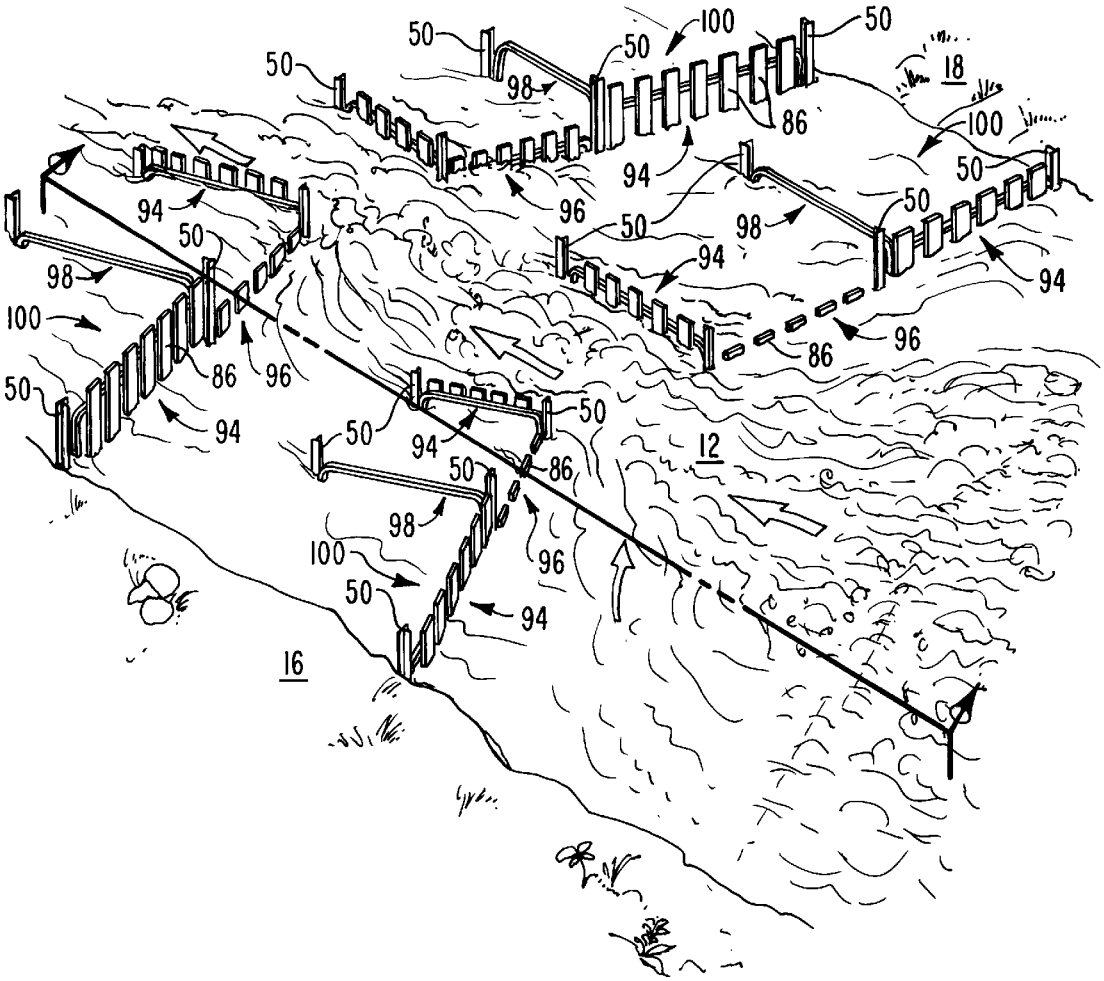
FIG. 11 illustrates a configuration of the prefabricated braces of the present invention in which a high prefabricated brace is placed adjacent a low prefabricated brace.

FIG. 11 shows yet another configuration of which the flow modification system 10 of the present invention is capable due to its unique capabilities. Shown therein is a series of prefabricated braces arranged in the path of the flow of water 12 much like in FIG. 3. Four sets of flow modification barriers 100 are secured in the channel, each comprising a high brace 94 secured to a shorter brace 96. Each individual flow modification barrier 100 is suitable for use in directing a portion of the flow of water 12 from a path through the higher brace 94 toward the side of the channel in which the shorter brace 96 is located. Thus, in cases where the outside of the channel has incurred disproportionate amounts of erosion, the flow of water will be shifted to the inside of the channel, reducing erosion on the outside of the channel.

Additionally, a reinforcing brace 98 can be secured between the higher braces 94 and the shorter braces 96. The reinforcing brace 98 typically shares a common post 50 with one of the higher braces 94 and the shorter braces 96. The reinforcing brace 98 serves to help prevent the higher braces 94 and the shorter braces 96 from being washed out. Additionally, the reinforcing brace 98 helps to keep the flow of a higher velocity which has been diverted to the right side of the channel from immediately returning to the left side of the channel, thus providing better protection to the first bank 16 on the left side of the channel. In the depicted embodiment a third prefabricated brace 84 is also connected extending down stream from an edge of each of the shorter braces 96. The third prefabricated brace 84 also helps to reinforce the higher brace 94 and the shorter brace 90, and is also provided with vanes 86 to help keep the flow of water 12 channeled away from the bank being protected.

Of course, it will be readily apparent to one skilled in the art that the shorter braces 96 could be eliminated or replaced with a higher brace 94. Also, each flow modification barrier 100 could be comprised of a plurality of higher braces 94 and/or a plurality of shorter braces 96. Also, it will be readily apparent that the reinforcing brace 98 need not necessarily be provided with vanes 86 if the purpose is reinforcement only.

FIG. 11 also shows the collective use of several such flow modification barriers in a terraced configuration much like that of FIG. 2. The configuration of FIG. 11 is presented for illustration purposes only. Of course, the whole system need not be used, and it will be apparent to one skilled in the art that the system can be modified to solve the particular water flow problem. For instance, only one flow modification barrier 100 could be used, or a series of flow modification barriers 100 could be used on one side. The flow modification barriers 100 could be angled toward the center of the channel as shown, or could be perpendicular to the flow of water 12.

Figure 12:
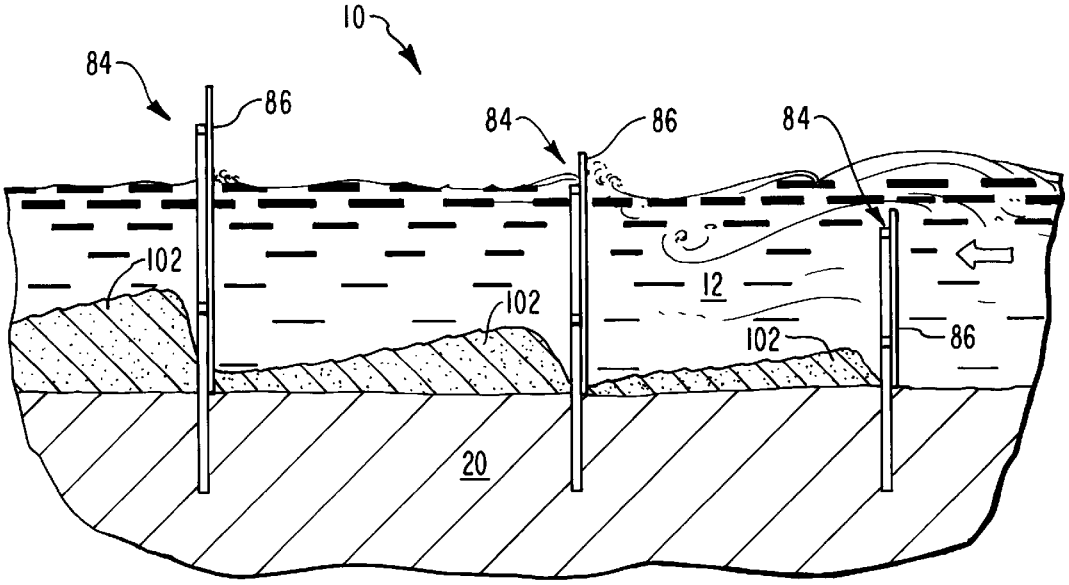
FIG. 12 illustrates a configuration of the prefabricated braces of the present invention in which the prefabricated braces are arranged in steps to create terraces in the channel bed.

FIG. 12 shows the effect of the configuration of FIG. 11 on the channel bed 20. As shown therein, the channel bed 20 has been transformed through the deposition of silt caused by a reduced velocity of the flow of water 12 around the prefabricated braces 84. A series of ridges 102 have been formed and assist in causing a terracing effect, even after removal of the flow modification system 10. Vegetation can grow on the tops of the ridges 102 during times of year when the flow of water 12 is low and will also help to slow the flow of water 12 during peak periods. Thus, once the flow of water 12 has been modified, the flow modification system 10 can be removed.

Additionally, when the prefabricated braces 84 of each of the terraces 104, 106 are angled away from the region being protected as shown, the ridges 102 will also help to carry the flow of water 12 away from the channel banks 16, 18 toward the center of the channel, thereby reducing the velocity and amount of the flow of water 12 passing by the channel banks 16, 18 and thus reducing erosion therein.

Figure 13:
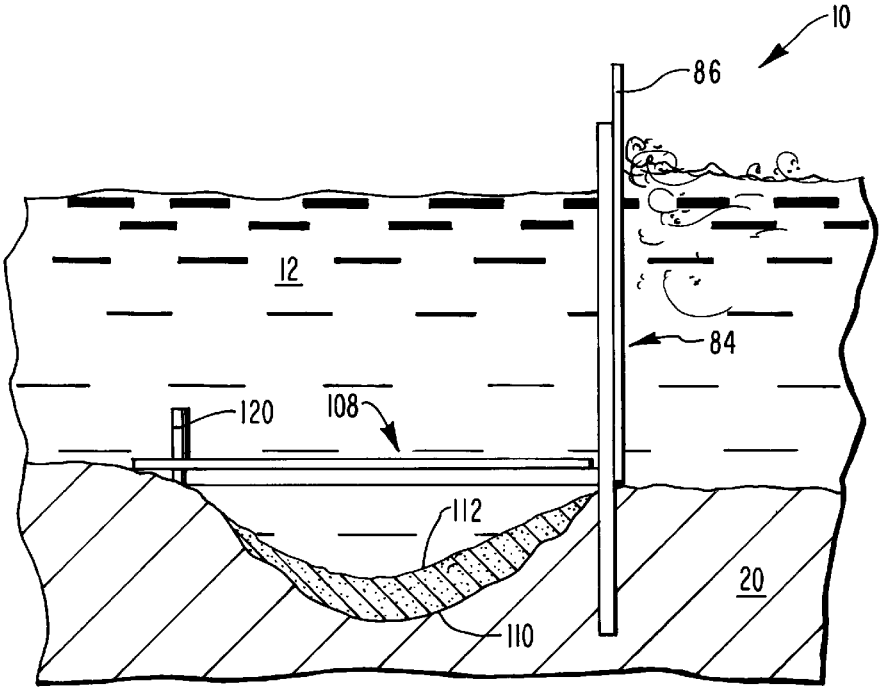
FIG. 13 illustrates a configuration of the prefabricated braces of the present invention in which one set of prefabricated braces is arranged vertically to modify the flow of water in a channel and a second set of prefabricated braces connected to the vertical prefabricated braces is arranged horizontally on the channel bed to prevent gouging of the channel bed.

FIG. 13 shows yet another configuration of the flow modification system 10 enabled by the present invention. Shown therein is a prefabricated brace 84 secured upright in the channel 14 in a manner to create resistance to the flow of water 12. Also placed in the channel is a horizontally oriented prefabricated brace 108. The horizontally oriented prefabricated brace 108 is secured length-wise to the bottom of the upright prefabricated brace 84 and/or to the bottoms of the posts 50 which secure the prefabricated brace 84 in position. The horizontally oriented prefabricated brace 108 is thus situated on the channel bed directly downstream of the prefabricated brace 84.

Such a configuration helps to brace and hold the flow modification system 10 in place. It also substantially prevents gouging of the channel bed 20 by turmoil of water flowing over the top of the prefabricated brace 84. Additionally, the build up of the channel bed 20 is facilitated, as the horizontally oriented prefabricated brace 108 tends to catch silt and gravel flowing along the bottom of the flow of water 12. To even better facilitate the build up of the channel bed 20, one or more vertically oriented slats 120 could be disposed cross-wise on the horizontally oriented prefabricated brace 108. The vertically oriented slats 120 preferably protrude several inches above the horizontally oriented prefabricated brace 108 and catch gravel and silt. Gouging in the channel bed 20 is represented by original bed profile 110. This gouging could be preexistent or could be caused by turmoil from high water levels passing over the prefabricated brace 86. The horizontally oriented prefabricated brace 108 prevents such turmoil from causing gouging. Additionally, the channel bed 20 is allowed to regenerate, as shown by a filled in portion 112.

Figure 14:
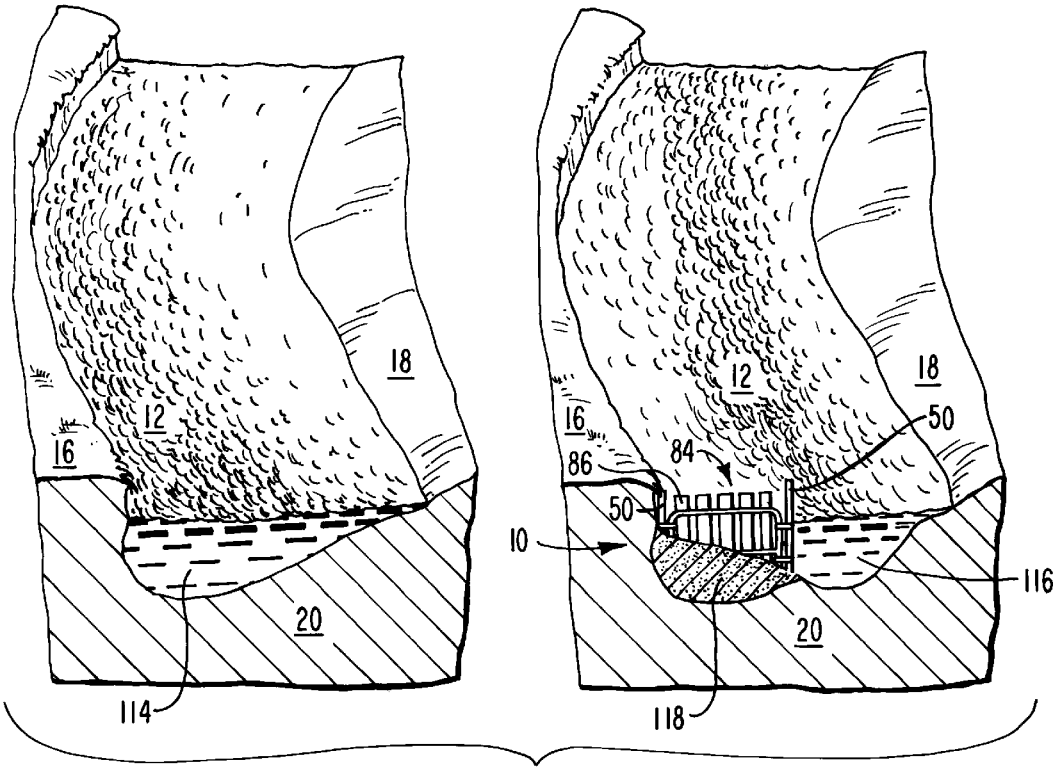
FIG. 14 illustrates the results of one embodiment of the method of the present invention in which the channel bed has been modified through the strategic placement of the prefabricated braces of the present invention.

FIG. 14 depicts a further aspect of the method of the present invention. In accordance with the method of modifying the flow of water in a channel of the present invention, the channel bed 14 can be altered so that the channel bed 14 assists in redirecting the flow of water. FIG. 14 shows the shape of the channel bed 20 prior to the installation therein of a flow modification system 10 of the present invention. As seen therein on the left-hand drawing, the deepest portion of the channel bed 20 is located toward the outside of the curve in the original channel 114. Because the flow of water 12 tends to migrate towards the outside of bends, a greater portion of the flow of water 12 moves along the outside of the curve than the inside. This causes a greater erosion of the channel bed 20 at the outside of the channel and thus the channel bed 20 is carved out and becomes deeper at the outside of the curve as shown.

When the flow modification system 10 of the present invention is employed in one of the manners described above to redirect a portion of the flow of water 12 to the inside of the channel 14, the channel bed 20 shifts as shown in the right-hand drawing. The increased flow of water 12 at the center and inside of the channel 14 causes the deepest portion of the channel to shift to the center of the channel as shown at 116. The outside of the channel bed 20 regenerates as shown by filled in portion 118. As there is less resistance where the channel is deeper, more of the flow of water 12 thereafter tends to flow into the center and inside of the channel, causing a substantial reduction in erosion of the first bank 16 and the channel bed 20 at the outside of the curve. Thus, any structures or crop lands located therein are spared from being eroded away. Due to the permanent or semi-permanent change in the channel bed 20, the diversion of the flow of water 12 to a different portion of the channel 14 continues even after the flow modification system 10 has been removed from the channel 14.

Illustrations are provided herein of the present invention's usefulness in modifying a flow of water which is flowing in a channel in which the prefabricated braces are placed and secured. However, it will be appreciated by those of skill in the art that the resistance offered to a flow of water may be modified whether the flow of water is present or not. Thus, the present invention also includes configuring one or more prefabricated braces in a channel which does not presently contain a flow of water. For example, one or more prefabricated braces may be secured across desert gullies that carry water only during occasional cloudbursts, or placed in stream beds downstream of a dam. Similarly, prefabricated braces may be configured along the banks of a river well above the river's normal level but not above its flood level.

In summary, the present invention provides an apparatus, system, and method for modifying the flow of water in a channel without placing substantial environmental contaminants in the water. Unlike automobile chassis, the prefabricated braces, posts, and matrices of the present system do not pose a substantial risk of releasing contaminants into a river or stream.

The present invention also provides an apparatus, system, and method which are suitable for use in channels of widely varying sizes, because the size of the prefabricated braces, as well as the number of prefabricated braces and posts employed, may be adapted to channels of many different sizes. Rather than requiring a user to dig holes in the channel to install large wooden posts into the channel bed, the present invention teaches the use of relatively small diameter posts which are easily driven into the channel. The sturdy prefabricated nature of the prefabricated braces and the use of steel T-posts allow the system to be easily installed in the channel.

Because the posts, prefabricated braces, and matrices or vanes form a structurally sound basis for flow modifiers, a sturdy flow modifier can be formed therewith. The flow modification system is much less susceptible than prior art flow modifiers to being washed out by rapid currents, even when configured perpendicular to the flow of water. The flow modification system is also unobtrusive, and does not substantially reduce the aesthetic appeal of the channel and the flow of water. In addition, the posts and prefabricated braces are modular and may be repositioned or even removed with substantially less effort than flow modifiers constructed solely of rocks or logs. Furthermore, due to the modular and sturdy nature of the flow modification system, a great variety of configurations of the flow modification system are available, making the flow modification system more effective and allowing it to be even more sturdy.

The invention may be embodied in other specific forms without departing from its spirit or essential characteristics. The described embodiments are to be considered in all respects only as illustrative and not restrictive. Any explanations provided herein of the scientific principles employed in the present invention are illustrative only. The scope of the invention is, therefore, indicated by the appended claims rather than by the foregoing description. All changes which come within the meaning and range of equivalency of the claims are to be emprefabricated braced within their scope.

What is claimed and desired to be secured by patent is:

1. A method for modifying the flow of water in a channel having a channel bed and a bank, said method comprising the steps of:

obtaining at least one prefabricated brace configured for connection to one or more posts, the prefabricated brace including:

two spaced apart rigid anchor ends; and at least one rigid cross beam connecting the anchor ends, the cross beam and the anchor ends being substantially coplanar;

obtaining a plurality of rigid substantially linear posts and driving at least two of the posts into the channel bed;

placing the prefabricated brace in the channel between the posts such that the prefabricated brace modifies the resistance offered to the flow of water and thereby reduces the velocity of the flow of water immediately downstream from the prefabricated brace; and securing the prefabricated brace in position with respect to the channel bed by securely connecting one anchor end to one of the posts and securely connecting the second anchor end to a second post, wherein the prefabricated brace is securely connected to two of the posts and is substantially coplanar with the posts between which the prefabricated brace is secured.

2. The method of claim 1, further comprising, providing the prefabricated brace with a plurality of longitudinally extending vanes fastened to the at least one rigid cross beam and disposed between the anchor ends, the vanes being coplanar with the prefabricated brace for partially obstructing the flow of the water to reduce the velocity thereof and to thereby reduce erosion in a bank of the channel in front of which the prefabricated brace is disposed.

3. The method of claim 2, further comprising, providing the vanes with a width, coplanar with the prefabricated brace of at least one inch.

4. The method of claim 2, further comprising, securing the prefabricated brace in a position substantially perpendicular to a portion of the flow of water in the channel, such that the vanes are also disposed perpendicular to the flow of water.

5. The method of claim 1, further comprising the steps of:

obtaining an additional prefabricated brace configured similar to the original prefabricated brace;

driving an additional post into the channel bed; and securely fastening one anchor end of the additional prefabricated brace to one of the original posts adjacent the original prefabricated brace and securely fastening a second anchor end of the additional prefabricated brace to the additional post.

6. The method of claim 5, further comprising, securing the original prefabricated brace and the additional prefabricated brace in a path along one side of the channel so as to reduce the velocity of a portion of the flow of water passing by the one side of the channel and to concurrently increase the velocity of a portion of the flow of water passing by the opposite side of the channel.

7. The method of claim 5, further comprising, securing the original prefabricated brace and the additional prefabricated brace together with at least one other prefabricated brace similar to the original prefabricated brace in a configuration enclosing at least three sides of a region of the channel.

8. The method of claim 5, further comprising, securing the original prefabricated brace and the additional prefabricated brace together with at least one other prefabricated brace similar to the original prefabricated brace in a configuration stretching from one bank of the channel to the opposite bank of the channel, and whereby the original prefabricated brace and the additional prefabricated brace are substantially perpendicular to the flow of water.

9. The method of claim 5, further comprising obtaining a third and a fourth prefabricated brace, and positioning the third prefabricated brace adjacent to and downstream of the original prefabricated brace and lying substantially flat on the channel bed and positioning the fourth prefabricated brace adjacent to and downstream of the additional prefabricated brace and also lying substantially flat on the channel bed, the third and fourth prefabricated braces thereby reducing the occurrence of gouging of the stream bed by water passing over the top of the original and the additional prefabricated braces.

10. The method of claim 5, further comprising:

obtaining a third prefabricated brace configured similar to the original prefabricated brace;

driving a third post into the channel bed downstream of the original post; and securely connecting one anchor end of the third prefabricated brace to the original post and connecting a second anchor end of the third prefabricated brace to the third post such that the third prefabricated brace is connected between and is perpendicular to the original and additional prefabricated braces to thereby reinforce the original and additional prefabricated braces.

11. The method of claim 5, further comprising, securing the original prefabricated brace and the additional prefabricated brace along an arcuate path having a convex side facing upstream to better resist the force of the flow of water.

12. The method of claim 1, further comprising the steps of placing an additional prefabricated brace in the channel and securing the additional prefabricated brace in position immediately downstream of the original prefabricated brace for creating a terraced weir which has an upstream terrace that includes the original prefabricated brace and a downstream terrace that includes the additional prefabricated brace.

13. The method of claim 11, further comprising, making one of the original prefabricated brace and the additional prefabricated brace shorter than the other to create a terraced weir of different heights which slows the velocity of the flow of water in degrees.

14. The method of claim 5, wherein one of the original and additional prefabricated braces comprises a low prefabricated brace and the other a high prefabricated brace, and further comprising, placing the prefabricated brace in the channel with a configuration such that the height above the channel bed of at least a portion of the high prefabricated brace greater than the height above the channel bed of substantially all of the low prefabricated brace to allow a greater velocity of the flow of water through the low prefabricated brace than through the high prefabricated brace and thereby redirect the flow of water in the channel.

15. The method of claim 1, further comprising the step of positioning an agglomeration matrix against the prefabricated brace on the upstream side of the prefabricated brace for modifying the flow of water by supporting and accumulating over time an agglomeration of materials carried against the agglomeration matrix by the water in the channel.

16. The method of claim 1, further comprising altering the velocity of the flow of water with the prefabricated brace and consequently causing the channel bed to be altered such that the flow of water in the channel is thereafter altered independent of the prefabricated brace.

17. The method of claim 1, further comprising reducing in velocity of a portion of the flow of water and gradually increasing the height of the channel bed through the deposition of silt from the flow of water of reduced velocity and further comprising an increased growth of vegetation in the channel bed directly downstream of the prefabricated brace.

18. A flow modification system for modifying the flow of water in a channel, said system comprising:

a plurality of rigid substantially linear posts;

at least one prefabricated brace configured for assembly with said posts to form said system, said prefabricated brace comprising:

two spaced apart rigid anchor ends;

at least one rigid cross beam connecting said anchor ends, said cross beam and said anchor ends being substantially coplanar; and a plurality of vanes attached to the at least one rigid cross beam and disposed between the two spaced apart rigid anchor ends, the vanes being coplanar with the prefabricated brace for partially obstructing the flow of water in a channel in which the system is located to reduce the velocity thereof and to thereby reduce erosion in a bank of the channel in front of which the prefabricated brace is disposed; and a plurality of connectors for securely connecting said prefabricated brace between two of said posts, said prefabricated brace being substantially coplanar with said posts between which said prefabricated brace is secured.

19. The flow modification system of claim 18, wherein the vanes have a width coplanar with the prefabricated brace of at least one inch.

20. The flow modification system of claim 18, wherein the prefabricated brace is secured in a channel in a position substantially perpendicular to a portion the flow of water in the channel, such that the vanes are also perpendicular to the flow of water.

21. The flow modification system of claim 18, further comprising:

an additional prefabricated brace configured substantially the same as the original prefabricated brace; and an additional substantially rigid post in the channel bed, and wherein one anchor end of the additional prefabricated brace is securely fastened to one of the original posts adjacent the original prefabricated brace and a second anchor end of the additional prefabricated brace is securely fastened to the additional post.

22. The flow modification system of claim 21, wherein the original prefabricated brace and the additional prefabricated brace are secured in a position along one side of the channel so as to reduce the velocity of a portion of the flow of water passing by the one side of the channel and to concurrently increase the velocity of a portion of the flow of water passing by the opposite side of the channel.

23. The flow modification system of claim 21, wherein the original prefabricated brace and the additional prefabricated brace are secured together with at least one other prefabricated brace similar to the original prefabricated brace in a configuration enclosing at least three sides of a region of the channel.

24. The flow modification system of claim 21, wherein the original prefabricated brace and the additional prefabricated brace are secured together with at least one other prefabricated brace similar to the original prefabricated brace in a configuration stretching from one bank of the channel to the opposite bank of the channel so that the original prefabricated brace and the additional prefabricated brace are substantially perpendicular to the flow of water.

25. The flow modification system of claim 21, further comprising a third and a fourth prefabricated brace, the third prefabricated brace positioned adjacent to and downstream of the original prefabricated brace and lying substantially flat on the channel bed, and the fourth prefabricated brace positioned adjacent to and downstream of the additional prefabricated brace and also lying substantially flat on the channel bed, the third and fourth prefabricated braces thereby reducing the occurrence of gouging of the stream bed by water passing over the top of the original and the additional prefabricated braces.

26. The flow modification system of claim 21, further comprising:

a third prefabricated brace configured similar to the original prefabricated brace; and a third post driven into the channel bed downstream of the original post, and wherein one anchor end of the third prefabricated brace is securely connected to the original post and a second anchor end of the third prefabricated brace is securely connected to the third post such that the third prefabricated brace is connected between and is perpendicular to the original and additional prefabricated braces to thereby reinforce the original and additional prefabricated braces.

27. The flow modification system of claim 21, wherein the original prefabricated brace and the additional prefabricated brace are secured along an arcuate path having a convex side facing upstream to better resist the force of the flow of water.

28. The flow modification system of claim 18, further comprising an additional prefabricated brace placed in the channel and secured in position immediately downstream of the original prefabricated brace for creating a terraced weir which has an upstream terrace that includes the original prefabricated brace and a downstream terrace that includes the additional prefabricated brace.

29. The flow modification system of claim 18, wherein one of the original prefabricated brace and the additional prefabricated brace is shorter than the other to create a terraced weir of different heights and thereby slow the velocity of the flow of water in degrees.

30. The flow modification system of claim 18, wherein one of the original and additional prefabricated braces comprises a low prefabricated brace and the other a high prefabricated brace, and whereby the height above the channel bed of at least a portion of the high prefabricated brace is greater than the height above the channel bed of substantially all of the low prefabricated brace, thereby allowing a greater velocity of the flow of water through the low prefabricated brace than through the high prefabricated brace, in order to redirect the flow of water in the channel.

31. The flow modification system of claim 18, further comprising an agglomeration matrix positioned against the prefabricated brace on the upstream side of the prefabricated brace for modifying the water flow by supporting and accumulating over time an agglomeration of materials carried against the agglomeration matrix by the water in the channel.

32. A prefabricated brace for use in a flow modification system to modify the flow of water in a channel, said prefabricated brace comprising:

two spaced apart rigid anchor ends, each of said anchor ends having at least one anchor site for connecting said anchor end to a post;

at least one rigid cross beam connecting said anchor ends, said cross beams and said anchor ends being substantially coplanar; and a plurality of vertically extending vanes attached to the at least one rigid cross beam and disposed between the two spaced apart rigid anchor ends for reducing the flow of water therethrough.

* * * * *